US009315067B2

(12) United States Patent
Chauvin, II

(10) Patent No.: US 9,315,067 B2
(45) Date of Patent: Apr. 19, 2016

(54) COMBINED WRITING UTENSIL AND LIGHT EMITTER ASSEMBLY

(71) Applicant: Curtis J. Chauvin, II, Thibodaux, LA (US)

(72) Inventor: Curtis J. Chauvin, II, Thibodaux, LA (US)

( * ) Notice: Subject to any disclaimer, the term of this patent is extended or adjusted under 35 U.S.C. 154(b) by 89 days.

(21) Appl. No.: 14/252,181

(22) Filed: Apr. 14, 2014

(65) Prior Publication Data

US 2015/0290964 A1 Oct. 15, 2015

(51) Int. Cl.

| | |
|---|---|
| ***B43K 29/00*** | (2006.01) |
| ***B43K 29/10*** | (2006.01) |
| ***B43K 24/06*** | (2006.01) |
| ***B43K 25/02*** | (2006.01) |

(52) U.S. Cl.

CPC ..... *B43K 29/10* (2013.01); *B43K 24/06* (2013.01); *B43K 25/024* (2013.01)

(58) Field of Classification Search

CPC ..... B43K 29/10; B43K 24/06; B43K 25/02
USPC ..... 401/195; 362/118
See application file for complete search history.

(56) References Cited

U.S. PATENT DOCUMENTS

| | | | | |
|---|---|---|---|---|
| 2,979,602 | A * | 4/1961 | Barnett | B43K 29/10 362/118 |
| 3,333,095 | A * | 7/1967 | Moess | B43K 29/10 362/118 |
| 3,384,742 | A * | 5/1968 | Delligatti | B43K 29/10 362/118 |
| 3,929,223 | A | 12/1975 | Ludeman | |
| D300,087 | S | 3/1989 | Henderson | |
| 5,470,164 | A * | 11/1995 | Chen | B43K 29/10 362/118 |
| D366,146 | S | 1/1996 | Bertrand | |
| D370,497 | S | 6/1996 | Moore et al. | |
| 5,570,967 | A * | 11/1996 | Chen | B43K 29/10 362/118 |
| 6,270,274 | B1 * | 8/2001 | Chao | A45C 11/04 401/195 |
| 6,299,372 | B1 * | 10/2001 | Wang | B43K 29/10 362/118 |
| RE38,014 | E | 3/2003 | Bieberstein | |
| 6,623,136 | B1 | 9/2003 | Kuo | |
| 6,837,639 | B2 * | 1/2005 | Hui | B43K 29/10 362/118 |
| 6,874,188 | B2 | 4/2005 | Johnson et al. | |
| 6,926,421 | B2 * | 8/2005 | Huang | B43K 24/02 362/118 |
| 6,994,446 | B2 | 2/2006 | Huang | |
| 7,086,797 | B1 * | 8/2006 | Huang | B43K 7/005 362/118 |

* cited by examiner

*Primary Examiner* — Jennifer C Chiang

(57) ABSTRACT

A combined writing utensil and light emitter assembly ensures that various accessories are readily accessible for use during hunting. The assembly includes a tube having a first end, a second end and a hollow interior configured to receive objects therein. A writing implement is provided having a main body and a tip. The writing implement is positionable within the hollow interior of the tube through the first end of the tube wherein the tip is positioned proximate the second end of the tube when the writing implement is positioned within the hollow interior. An light emitter is coupled to the second end of the tube. A first end cap is coupled to a distal end of the main body with respect to the tip. The first end cap is removably couplable to the first end of the tube for securing the writing implement within the hollow interior.

10 Claims, 3 Drawing Sheets

COMBINED WRITING UTENSIL AND LIGHT EMITTER ASSEMBLY

BACKGROUND OF THE DISCLOSURE

Field of the Disclosure

The disclosure relates to writing utensil assemblies and more particularly pertains to a new writing utensil assembly for ensuring that various accessories are readily accessible for use during hunting.

SUMMARY OF THE DISCLOSURE

An embodiment of the disclosure meets the needs presented above by generally comprising a tube having a first end, a second end and a hollow interior configured to receive objects therein. A writing implement is provided having a main body and a tip. The writing implement is positionable within the hollow interior of the tube through the first end of the tube wherein the tip is positioned proximate the second end of the tube when the writing implement is positioned within the hollow interior. An light emitter is coupled to the second end of the tube. A first end cap is coupled to a distal end of the main body with respect to the tip. The first end cap is removably couplable to the first end of the tube for securing the writing implement within the hollow interior.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
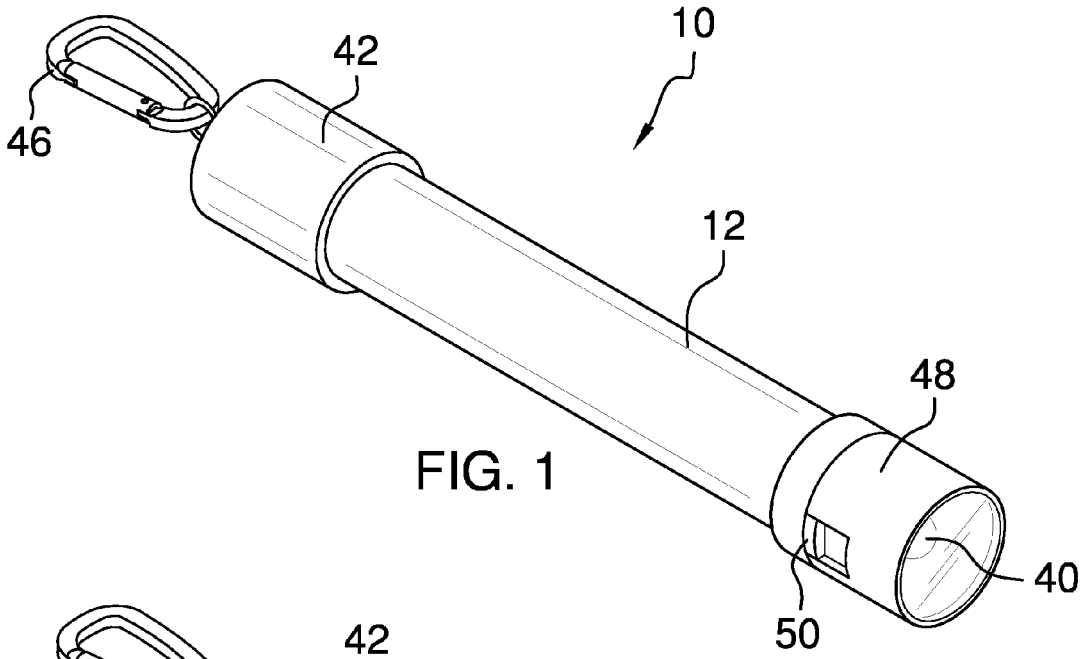
FIG. 1 is a top front side perspective view of a combined writing utensil and light emitter assembly according to an embodiment of the disclosure.
Figure 2:
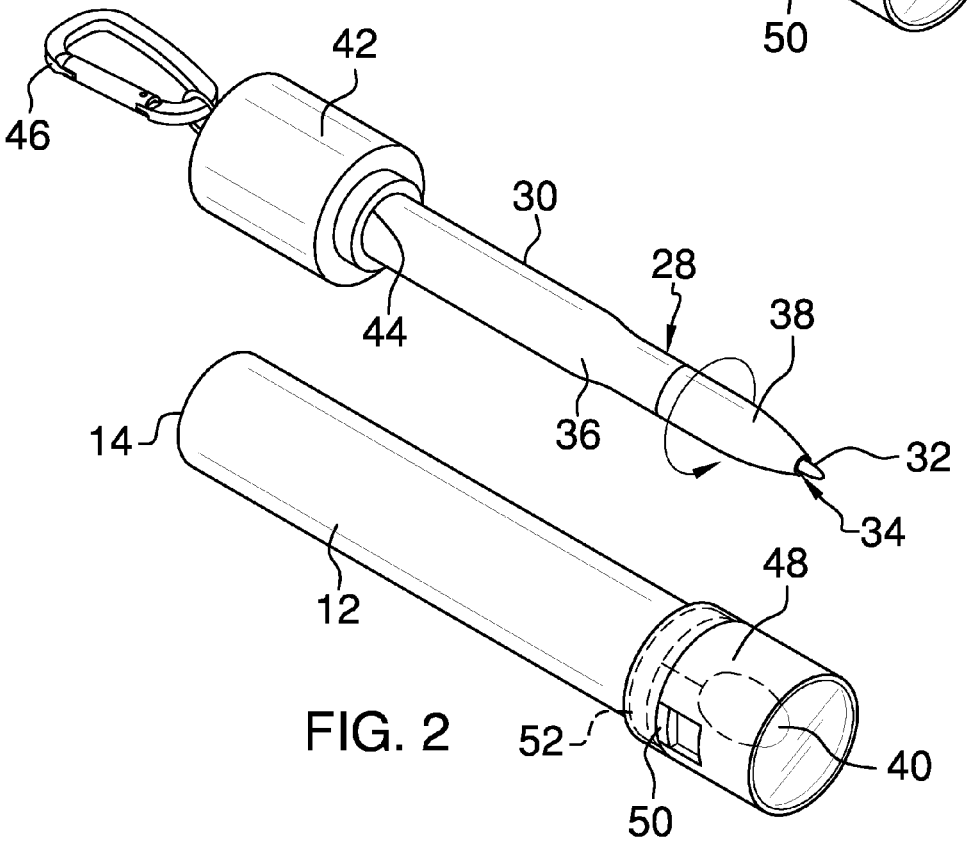
FIG. 2 is an exploded top front side perspective view of an embodiment of the disclosure.
Figure 3:
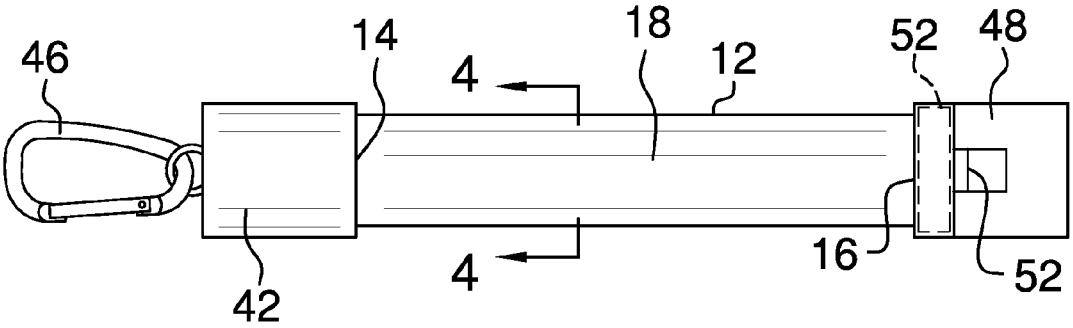
FIG. 3 is a side view of an embodiment of the disclosure.
Figure 4:
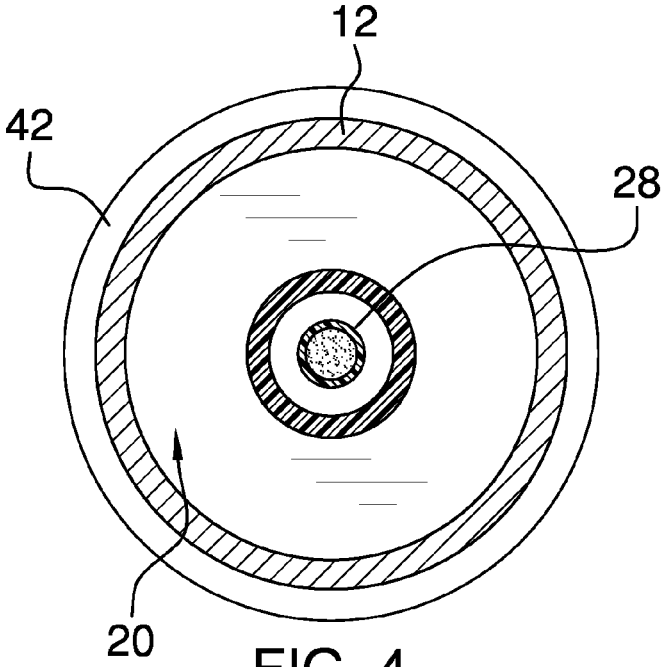
FIG. 4 is a cross-sectional view of an embodiment of the disclosure taken along line 4-4 of FIG. 3.
Figure 5:
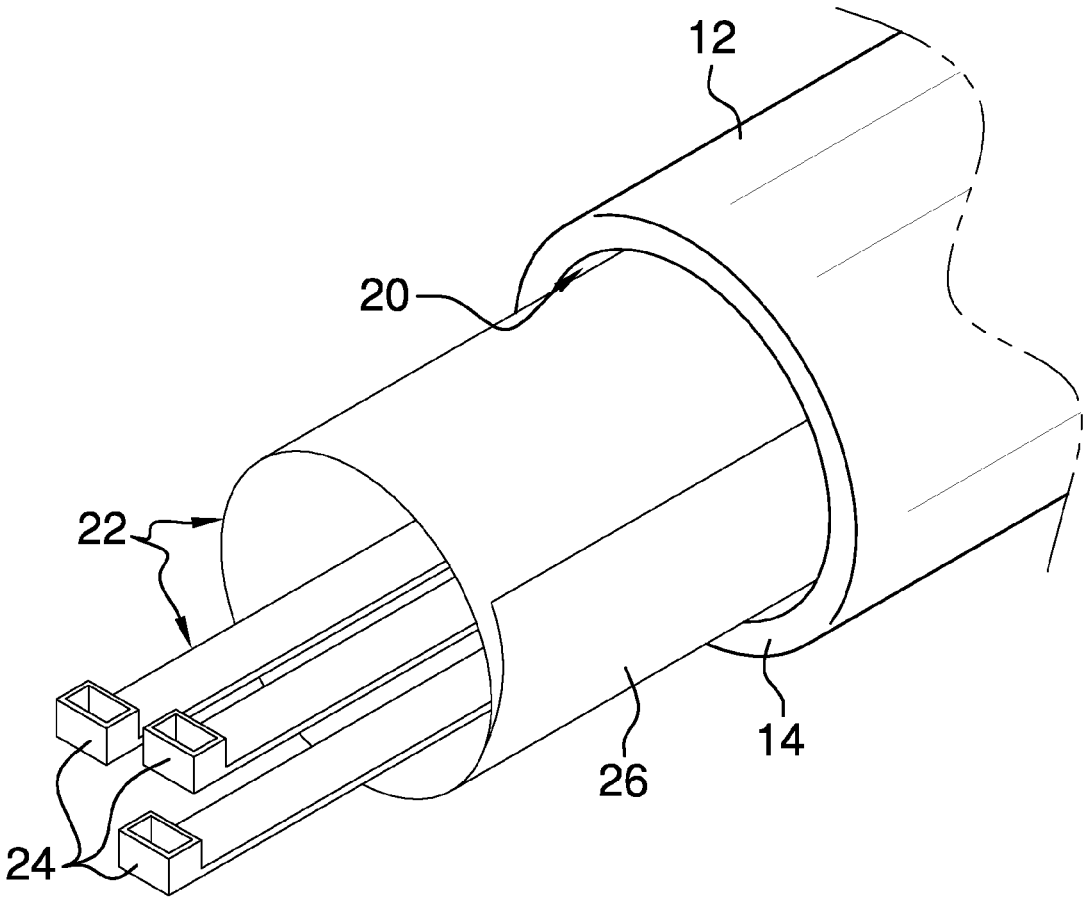
FIG. 5 is a detailed view of tie straps and paperwork positioned within a tube of an embodiment of the disclosure.

With reference now to the drawings, and in particular to FIGS. 1 through 5 thereof, a new writing utensil assembly embodying the principles and concepts of an embodiment of the disclosure and generally designated by the reference numeral 10 will be described.

As best illustrated in FIGS. 1 through 5, the combined writing utensil and light emitter assembly 10 generally comprises a tube 12 having a first end 14, a second end 16 and perimeter surface 18 coupled to and extending between the first end 14 and the second end 16. The tube 12 may be constructed from a rigid material, such as hard plastic or the like. The tube 12 has a hollow interior 20 configured to receive objects 22 therein. The objects 22 may include a plurality of tie straps 24 and paperwork 26 related to hunting, such as hunting tags and/or licenses. The tube 12 may be translucent to permit viewing into the hollow interior 20. The tube 12 may have a length between approximately 12.0 cm and 22.0 cm as measured between the first end 14 and the second end 16 of the tube 12. An outer diameter of the tube 12 may measure between approximately 1.5 cm and 3.5 cm.

A writing implement 28 is provided having a main body 30 and a tip 32. The writing implement 28 may include anything useful for marking other objects, such as a pen, pencil or the like. However, as the assembly 10 will ideally be used while hunting, the writing implement 28 is preferably a pen to comply with hunting regulations that require ink to be printed on hunting tags. The writing implement 28 is removably positionable within the hollow interior 20 of the tube 12 through the first end 14 of the tube 12 wherein the tip 32 is positioned proximate the second end 16 of the tube 12 when the writing implement 28 is positioned within the hollow interior 20. Thus, the writing implement 28 must be removed entirely from the tube 12 in order to use the writing implement 28. The main body 30 has an opening 34 positioned therein. The tip 32 of the writing implement 28 is retractable into the main body 30 through the opening 34. The main body 30 of the writing implement 28 includes a first section 36 and a second section 38. The main body 30 is mechanically coupled to the tip 32 wherein twisting the second section 38 relative to the first section 38 causes the tip 32 to retract into and out of the main body 30 in a conventional manner, such as through the use of a spring-loaded plunger. The main body 30 of the writing implement 28 may have an outer diameter that varies in size along a longitudinal axis of the main body 30 and in particular may be designed to resemble a bullet casing.

A light emitter 40 is coupled to the second end 16 of the tube 12. A first end cap 42 is coupled to a distal end 44 of the main body 30 with respect to the tip 32. The first end cap 42 is removably couplable to the first end 14 of the tube 12 for securing the writing implement 28 within the hollow interior 20. A clip 46 is attached to the first end cap 42. The clip 46 allows the assembly 10 to be attached to a hunting bag, belt loop or the like. A second end cap 48 is coupled to the second end 16 of the tube 12. The light emitter 40 is positioned within the second end cap 48. Each of the first end cap 42 and the second end cap 48 may be constructed from a waterproof or water-resistant material, such as rubber, soft plastic or the like. Each of the first 42 and second 48 end caps may be bright orange in color, similar to the orange that is commonly worn by hunters and mandated by hunting regulations. The light emitter 40 may comprise a light emitting diode or the like. The light emitter 40 may emit either colored or non-colored light.

An on/off switch 50 is coupled to the second end cap 48. The on/off switch 50 is electrically coupled to the light emitter 40 for activating and deactivating the light emitter 40. A power source 52 is positioned within the second end cap 48. The power source 52 is electrically coupled to the light emitter 40 for providing power to the light emitter 40. The power source 52 may comprise at least one rechargeable battery.

In use, as stated above and shown in the Figures, the clip 46 may be used to attach the assembly 10 to a bag, belt loop or the like while a person is hunting. Objects 22, such as a plurality of tie straps 24 and paperwork 26 related to hunting, such as hunting tags, licenses and the like, are positioned within the hollow interior 20 of the tube 12. When the hunter kills an animal, the tie straps 24, writing implement 28 and hunting tags are removed from the tube 12. The writing implement 28 is used to mark the hunting tags with required information about the kill. The tie straps 24 are used to secure a hunting tag around each animal that was killed. The light emitter 40 is actuated to provide a flashlight for use in low-lighted conditions. In this manner, the assembly 10 ensures that various hunting accessories are readily available while a person is hunting.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A combined writing utensil and light emitter assembly comprising:

a tube having a first end, a second end and perimeter surface coupled to and extending between said first end and said second end, said tube having a hollow interior configured to receive objects therein;

a writing implement having a main body and a tip, said main body having an opening positioned therein, said tip of said writing implement being retractable into said main body through said opening, said writing implement being removably positionable within said hollow interior of said tube through said first end of said tube wherein said tip is positioned proximate said second end of said tube when said writing implement is positioned within said hollow interior;

an light emitter coupled to said second end of said tube; and a first end cap coupled to a distal end of said main body with respect to said tip, said first end cap being removably couplable to said first end of said tube for securing said writing implement within said hollow interior.

2. The assembly of claim 1, further comprising a clip attached to said first end cap.

3. The assembly of claim 1, further comprising a second end cap coupled to said second end of said tube, said light emitter being positioned within said second end cap.

4. The assembly of claim 1, further comprising said tube being translucent to permit viewing into said hollow interior.

5. The assembly of claim 3, further comprising each of said first end cap and said second end cap being constructed from a waterproof material.

6. The assembly of claim 3, further comprising an on/off switch coupled to said second end cap, said on/off switch being electrically coupled to said light emitter for activating and deactivating said light emitter.

7. The assembly of claim 3, further comprising a power source positioned within said second end cap, said power source being electrically coupled to said light emitter for providing power to said light emitter.

8. The assembly of claim 1, further comprising a plurality of tie straps being positionable within said hollow interior of said tube.

9. The assembly of claim 1, further comprising said main body of said writing implement including a first section and a second section, said main body being mechanically coupled to said tip wherein twisting said second section relative to said first section causes said tip to retract into and out of said main body.

10. A combined writing utensil and light emitter assembly comprising:

a tube having a first end, a second end and perimeter surface coupled to and extending between said first end and said second end, said tube having a hollow interior configured to receive objects therein, said tube being translucent to permit viewing into said hollow interior;

a writing implement having a main body and a tip, said writing implement being removably positionable within said hollow interior of said tube through said first end of said tube wherein said tip is positioned proximate said second end of said tube when said writing implement is positioned within said hollow interior, said main body having an opening positioned therein, said tip of said writing implement being retractable into said main body through said opening, said main body of said writing implement including a first section and a second section, said main body being mechanically coupled to said tip wherein twisting said second section relative to said first section causes said tip to retract into and out of said main body;

an light emitter coupled to said second end of said tube;

a first end cap coupled to a distal end of said main body with respect to said tip, said first end cap being removably couplable to said first end of said tube for securing said writing implement within said hollow interior;

a clip attached to said first end cap;

a second end cap coupled to said second end of said tube, said light emitter being positioned within said second end cap, each of said first end cap and said second end cap being constructed from a waterproof material;

a plurality of tie straps being positionable within said hollow interior of said tube;

an on/off switch coupled to said second end cap, said on/off switch being electrically coupled to said light emitter for activating and deactivating said light emitter; and a power source positioned within said second end cap, said power source being electrically coupled to said light emitter for providing power to said light emitter.

* * * * *